US009187211B2

(12) United States Patent
Kappes

(10) Patent No.: US 9,187,211 B2
(45) Date of Patent: Nov. 17, 2015

(54) MILLING JAR WITH INTEGRATED LIFTERS

(71) Applicant: Kappes, Cassiday & Associates, Reno, NV (US)

(72) Inventor: Daniel W. Kappes, Reno, NV (US)

(73) Assignee: Kappes, Cassiday & Associates, Reno, NV (US)

( * ) Notice: Subject to any disclaimer, the term of this patent is extended or adjusted under 35 U.S.C. 154(b) by 257 days.

(21) Appl. No.: 13/827,470

(22) Filed: Mar. 14, 2013

(65) Prior Publication Data

US 2014/0263159 A1 Sep. 18, 2014

(51) Int. Cl.

| | |
|---|---|
| ***B65D 23/00*** | (2006.01) |
| ***B02C 17/04*** | (2006.01) |
| ***B02C 17/18*** | (2006.01) |
| ***B01F 9/00*** | (2006.01) |
| ***B01F 9/06*** | (2006.01) |

(52) U.S. Cl.

CPC ..... *B65D 23/00* (2013.01); *B01F 9/0016* (2013.01); *B01F 9/06* (2013.01); *B02C 17/04* (2013.01); *B02C 17/1825* (2013.01)

(58) Field of Classification Search

CPC ..... B65D 23/00; B65D 1/0233; B65D 2501/0036; B65D 1/16; C12M 23/02; C12M 23/08; B02C 17/18

USPC ..... 220/669; 215/383, 382, 384; 435/304.1; 241/179

See application file for complete search history.

(56) References Cited

U.S. PATENT DOCUMENTS

| | | | | |
|---|---|---|---|---|
| 2,063,013 | A | 12/1936 | Cooper | |
| 3,185,192 | A | 5/1965 | Delcellier | |
| 4,824,787 | A * | 4/1989 | Serkes et al. | 435/299.2 |
| 4,829,004 | A * | 5/1989 | Varani et al. | 435/304.2 |
| 4,912,048 | A * | 3/1990 | Smith et al. | 435/299.2 |
| 4,962,033 | A * | 10/1990 | Serkes et al. | 435/395 |
| 5,010,013 | A * | 4/1991 | Serkes et al. | 435/299.2 |
| 5,403,086 | A * | 4/1995 | Lindesay | 366/59 |
| 5,651,613 | A * | 7/1997 | Mays et al. | 366/227 |
| 5,934,800 | A | 8/1999 | Bonacci | |
| 6,349,839 | B1 * | 2/2002 | Mooney | 215/384 |
| 6,497,333 | B1 * | 12/2002 | Ellis et al. | 215/383 |
| 6,857,531 | B2 * | 2/2005 | Slat et al. | 215/382 |
| 6,983,858 | B2 * | 1/2006 | Slat et al. | 215/373 |
| D566,563 | S | 4/2008 | Trost | |
| 7,449,331 | B2 | 11/2008 | Whitley | |
| 7,798,350 | B2 * | 9/2010 | Hermel et al. | 215/382 |
| 7,838,054 | B2 | 11/2010 | Thornton et al. | |
| 2011/0011825 | A1 * | 1/2011 | Howell et al. | 215/381 |

* cited by examiner

*Primary Examiner* — Steven A. Reynolds

(74) *Attorney, Agent, or Firm* — Leech Tishman Fuscaldo & Lampl; Kenneth D'Alessandro, Esq.

(57) ABSTRACT

A milling jar has a jar body and a jar neck. The jar body has an internal surface and an external surface. Ridges with gently sloping slides, called "lifters," are formed by indenting the surface of the jar wall so that the internal surface projects toward the center of the jar. Because the depressions (on the external surface) and the lifters (on the internal surface) are segmented, portions of the circumference of the jar remain cylindrical. The jar neck has a lid that secures the materials inside the jar when the lid is fastened.

12 Claims, 2 Drawing Sheets

MILLING JAR WITH INTEGRATED LIFTERS

BACKGROUND

1. Field of the Invention

The present invention generally relates to milling jars. More specifically, the present invention relates to a milling jar with integrated lifters.

2. Description of the Related Art

Jar mills are commonly employed for mixing, sifting, grinding, and/or polishing raw materials. A mechanical jar mill consists of at least one pair of parallel rollers horizontally mounted to a frame. The rollers are operated by motors, which cause the rollers to rotate in the same direction at variable speeds. A milling jar is placed on top of the rotating rollers, which rotate the milling jar. Generally, a suspension consisting of particulate materials in a liquid is placed inside the milling jar.

When the milling jar is rotated at the correct speed, the force inside the milling jar keeps the particulate materials against the jar wall as it rotates, and gravity will pull the particulate materials from the wall and cause the particulate materials to fall before the jar has spun an entire rotation. Abrasion or friction between the particulate materials causes the desired mixing, sifting, grinding, and/or polishing.

If the milling jar is rotated too quickly, the force keeping the particulate materials against the jar wall will be stronger than gravity, thereby causing the particulate materials to remain against the jar wall for an entire rotation. As a result, there will be no friction between the particulate materials. This is known in the art as "centrifuging." If the jar is rotated too slowly, the force will not be strong enough to keep the particulate materials against the jar wall, and gravity will cause them to remain at the bottom of the jar. Again, the absence of friction will prevent the particulate materials from being mixed, sifted, polished, and/or ground.

To prevent problems associated with rotation speed, lifter bars are often placed inside the milling jars at 90 degree angles to the jar walls. Some of the particulate materials collect on the bars and are lifted upwards as the milling jar rotates between 0 and 180 degrees, and then fall from the bars due to gravity when the milling jar rotates between 180 and 360 degrees. Additionally, baffles are sometimes placed inside milling jars to help direct the flow of the materials. However, the placement of lifter bars and baffles on the interior of the milling jars is cumbersome. Removing particulate materials from the jar after the milling process is complete is also difficult. Moreover, use of these devices does not promote constant movement of the particulate materials inside the milling jars because some of the particulate materials get caught on the sharp edges of the lifting bars or baffles.

Therefore, there is a need for a milling jar having axial lifters with smooth surfaces that are integrated into the jar walls during the casting process.

SUMMARY OF THE INVENTION

A milling jar has a jar body and a jar neck. The jar body has an internal surface and an external surface. Ridges with gently sloping slides, called "lifters," are formed by indenting the surface of the jar wall so that the internal surface projects toward the center of the jar. Because the depressions (on the external surface) and the lifters (on the internal surface) are segmented, portions of the circumference of the jar remain cylindrical. The jar neck has a lid that secures the materials inside the jar when the lid is fastened.

BRIEF DESCRIPTION OF THE DRAWINGS

Features of the invention are further disclosed in the following detailed description, referencing the following drawings, in which.

DETAILED DESCRIPTION

Persons of ordinary skill in the art will realize that the following description of the present invention is illustrative only and not in any way limiting. Other embodiments of the invention will readily suggest themselves to such skilled persons.

Figure 1A:
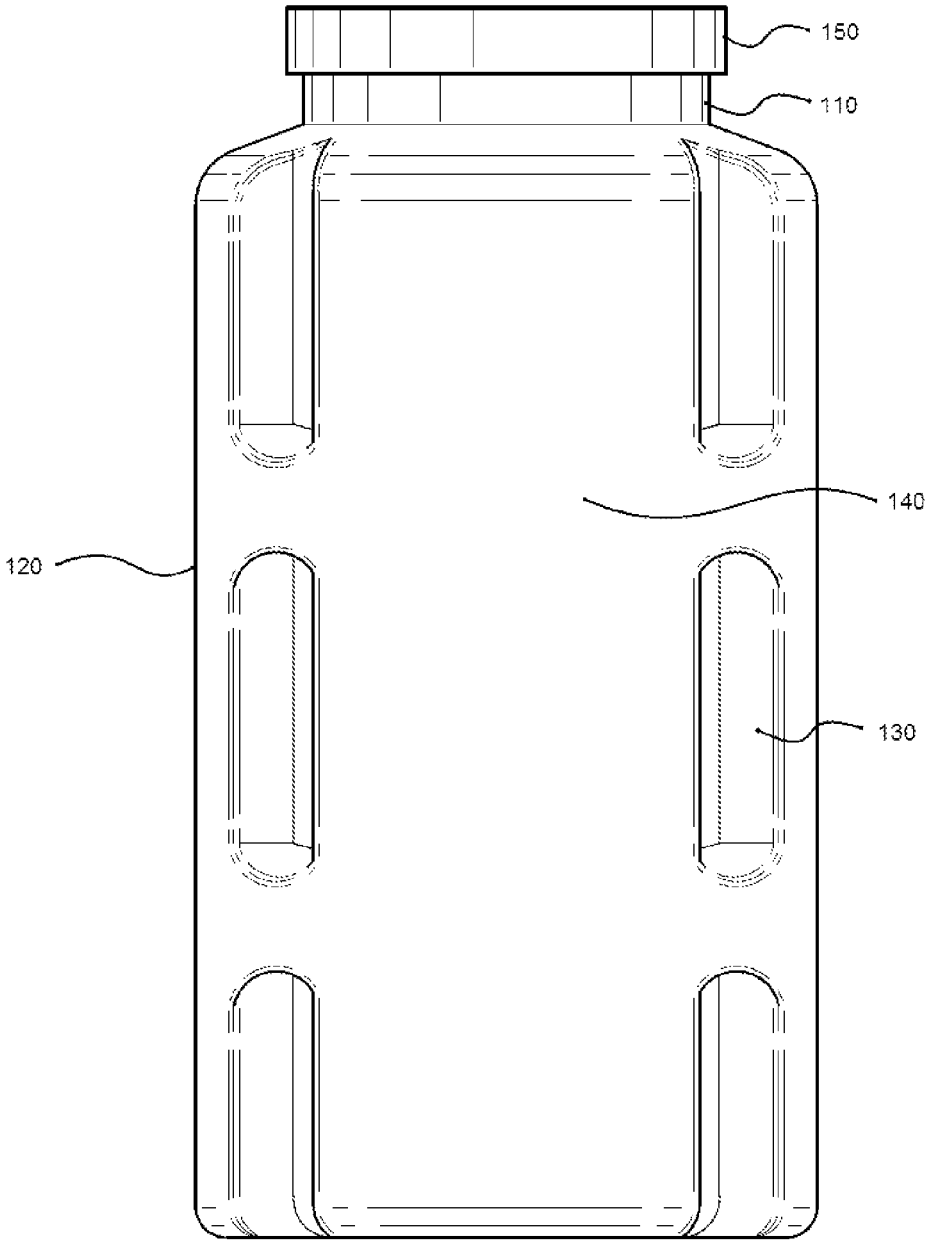
FIG. 1A illustrates an external view of an exemplary milling jar having internal lifters, external depressions, and cylindrical portions.

Referring now to FIG. 1A, illustrating an external view of an exemplary milling jar with a jar neck 110 and jar body 120 having internal axial ridges with sloping sides, referred to as "lifters" (not shown) along the length of the jar body 120. The lifters are formed by indenting the surface of the jar wall so that the internal surface projects toward the center of the jar body 120 when the jar is formed by using a process such as rotational molding or blow molding. The molding process creates depressions, one of which is labeled 130, on the external surface of the jar body 120. Because the lifters are integrated into the wall during the casting process, the thickness of the jar wall is approximately the same at each point, including at depressions 130. The depth of depressions 120 will vary based on the circumference of the jar body 120, but it is envisioned that the depressions will be at least one-half inch in depth as measured from the jar circumference.

The depressions on the external surface of the jar do not run continuously along the entire length of the jar but rather are segmented. Because the depressions (on the external surface) and the lifters (on the internal surface) are segmented, portions of the circumference of the jar remain cylindrical. One of the cylindrical portions is labeled 140. The cylindrical portions 140 are also spaced axially along the external length of the jar body 120 between the depressions 130 and likewise along the internal length of the jar body 120 between the lifters (not shown). The jar also contains a lid 150, which may be, for example, a screw lid that requires screw threads (not shown) on the jar neck 110, or any other type of lid that is capable of securing the jar contents inside the jar during the milling process.

Figure 1B:
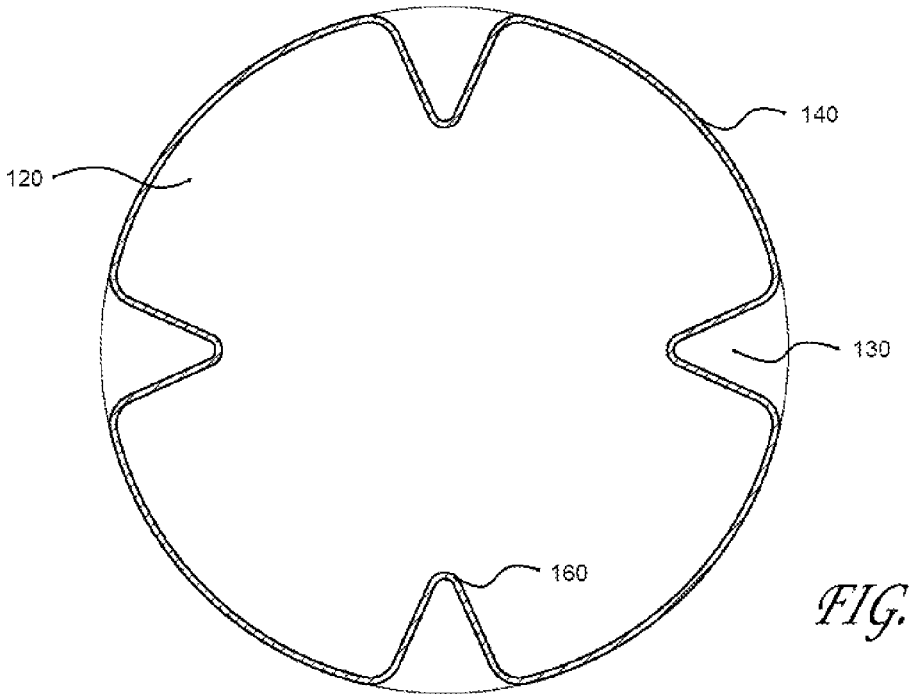
FIG. 1B illustrates a cross-sectional view of the circumference of the milling jar across the depressions.

FIG. 1B illustrates a cross-section of the circumference of the jar body 120 across the depressions 130. Lifters, one of which is labeled 160, have gently sloping walls that extend toward the center of jar body 120. As previously described, the formation of the lifters creates depressions 130 on the external surface of jar body 120. With respect to the radius that bisects the jar body 120, the lifters 130 create an angle of between about 10 degrees and about 25 degrees. In an exemplary embodiment of the present invention, the with respect to the radius that bisects the jar body 120, the lifters 130 create an angle of between about 22.5 degrees and about 25 degrees. The sloping sides of the lifters are intended to gently lift and mix the jar contents, without sharp corners or internal edges on which particulate materials may get caught. This lifter design prevents the uneven mixing that can result from the use of lifter bars and baffles, as in the prior art.

Figure 1C:
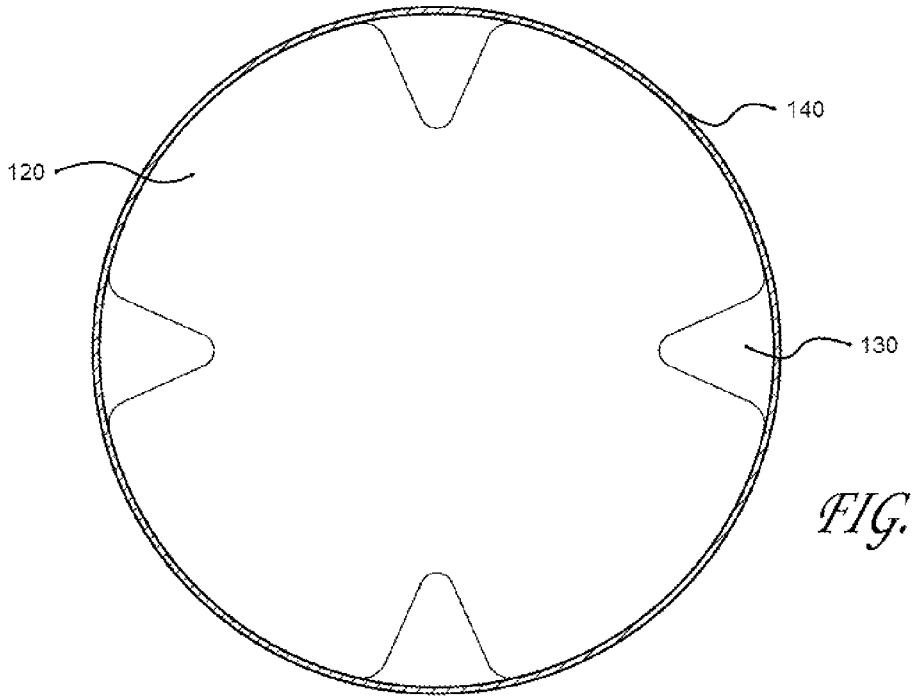
FIG. 1C illustrates a cross-sectional view of the circumference of the milling jar across the cylindrical portions.

FIG. 1C illustrates a cross-section of the circumference of jar body 120 across the cylindrical portions 140. The cylindrical portions 140 are spaced between the segmented depressions 130 on the outer surface of the jar to prevent the jar from becoming caught between the rollers of a mechanical jar mill. Placing cylindrical portions between the depressions thereby prevents disruption of rolling action of the jar when the external depressions line up with the rollers. Additionally, the cylindrical portions 140 provide turbulence when the jar is rolled on the mechanical jar mill, which further enhances mixing of the jar contents.

In an exemplary embodiment of the present invention, as few as two and as many as twelve lifters may be spaced at least one inch apart around the circumference of the jar. The number and size of lifters will depend largely on the circumference of the milling jar. Any number of lifters could be used so long as they are spaced sufficiently apart to allow the jar contents to settle between the lifters at some point during the rotation of the jar.

It is envisioned that the present invention may be used in conjunction with any set of mechanical rollers, many different types of which are commercially available. The milling jar may be composed of plastic, glass, or any other material that allows molding the lifters into the jar during the casting process.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A milling jar, comprising:

a jar body formed as a cylindrical wall to define an internal volume, the cylindrical wall closed at a first end and open at a second end;

a jar neck extending from the second end of the cylindrical wall and configured to receive a lid to seal the jar;

a plurality of lifters formed as segmented linear indentations in the cylindrical wall that extend into the internal volume of the jar, the segmented linear indentations having a long dimension and a short dimension, the long dimension aligned axially along the cylindrical wall, the lifters radially aligned with one another and spaced apart from one another around the circumference of the cylindrical wall to leave at least two completely uninterrupted radially-aligned cylindrical regions along the cylindrical wall.

2. The milling jar of claim 1, wherein the segmented indentations extend one-half inch into the internal volume of the jar defined by the cylindrical wall.

3. The milling jar of claim 1, wherein the lifters are radially spaced equidistant from one another.

4. The milling jar of claim 3, wherein the lifters are radially spaced about 90° from one another.

5. The milling jar of claim 3 wherein the lifters comprise from between two to twelve lifters that are radially spaced equidistant from one another.

6. The milling jar of claim 1 wherein the lifters comprise sloping walls that form an angle of about between 22.5° and about 25° with respect to a radius that bisects the jar body.

7. The milling jar of claim 1 wherein the lifters comprise sloping walls that form an angle of about between 10° and about 25° with respect to a radius that bisects the jar body.

8. The milling jar of claim 1 wherein the jar neck is threaded to receive a threaded lid to seal the jar.

9. The milling jar of claim 1 wherein the jar body is formed from glass.

10. The milling jar of claim 1 wherein the jar body is formed from plastic.

11. The milling jar of claim 1 wherein the lifters are formed in the cylindrical wall of the jar body by a molding process that forms the jar.

12. The milling jar of claim 1 wherein the jar neck has a smaller diameter than the jar body.

* * * * *